US007031601B2

(12) United States Patent
Zheng

(10) Patent No.: US 7,031,601 B2
(45) Date of Patent: Apr. 18, 2006

(54) EQUIPMENT FOR PRODUCING HIGH-PRESSURE SATURATED STEAM

(76) Inventor: Yeqi Zheng, 501 No. 38, Block 34, Shuiyin Road, Dongshan District, Guangzhou City, Guangdong Province (CN) 510075

( * ) Notice: Subject to any disclaimer, the term of this patent is extended or adjusted under 35 U.S.C. 154(b) by 0 days.

(21) Appl. No.: 10/468,808

(22) PCT Filed: Feb. 26, 2001

(86) PCT No.: PCT/CN01/00150

§ 371 (c)(1),
(2), (4) Date: Sep. 24, 2004

(87) PCT Pub. No.: WO02/070950

PCT Pub. Date: Sep. 12, 2002

(65) Prior Publication Data

US 2005/0169614 A1 Aug. 4, 2005

(30) Foreign Application Priority Data

Feb. 23, 2001 (CN) ..... 01107560 A

(51) Int. Cl.
*A61H 33/06* (2006.01)

(52) U.S. Cl. ..... 392/394; 392/399

(58) Field of Classification Search ..... 392/465–484
See application file for complete search history.

(56) References Cited

U.S. PATENT DOCUMENTS

| | | | | |
|---|---|---|---|---|
| 2,299,849 | A * | 10/1942 | Rees | 60/39.59 |
| 4,572,943 | A | 2/1986 | Hogfeldt | 219/273 |
| 6,393,212 | B1 * | 5/2002 | Hutchinson | 392/491 |

FOREIGN PATENT DOCUMENTS

| | | |
|---|---|---|
| CN | A-87 1 05782 | 3/1988 |
| CN | Y-2302394 | 12/1998 |
| JP | A-2-161916 | 6/1990 |

* cited by examiner

*Primary Examiner*—Thor S. Campbell
(74) *Attorney, Agent, or Firm*—Steptoe & Johnson LLP

(57) ABSTRACT

This invention relates to an equipment for producing high-pressure saturated steam. The equipment includes a water tank, a pump, a check valve, an atomizing nozzle, a heat chamber and a steam outlet. The pump is connected between water tank and the check valve. The check valve is connected with the heat chamber via the atomizing nozzle. The heat chamber having a steam outlet is hollow into which the atomizing nozzle extends. The hollow chamber is divided into many small chambers which are connected with each other successively. The equipment can produce high temperature steam rapidly and save energy.

4 Claims, 5 Drawing Sheets

EQUIPMENT FOR PRODUCING HIGH-PRESSURE SATURATED STEAM

THE TECHNICAL SECTOR THIS DEVICE IS RELATED TO

Figure 1:
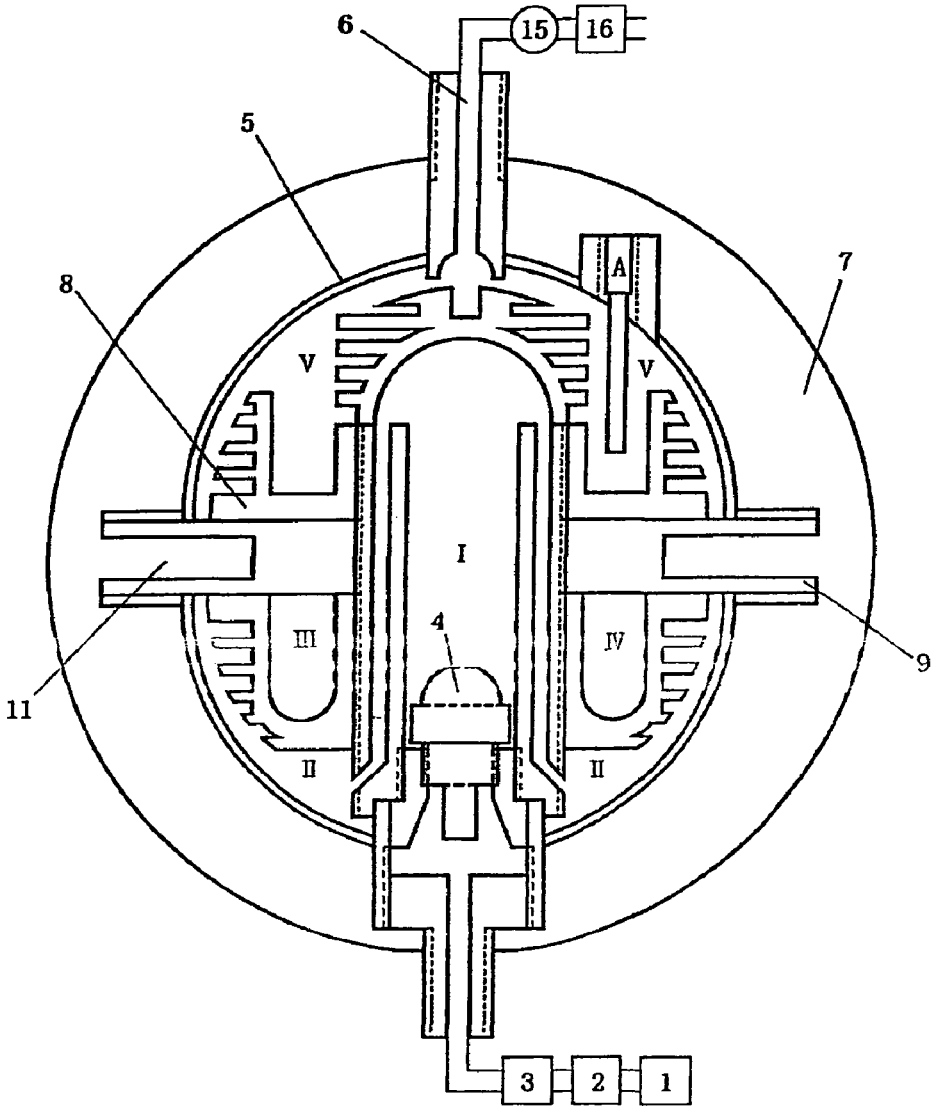

This invention relates to a device for generating high-pressure, saturated steam.

THE PRIOR ART

The application of steam is very broad, ranging from industrial, agricultural, domestic to medical applications. The traditional method to generate steam is to heat water to boiling point. Industrial boilers utilizing waste heat, domestic boilers or thermo-electric boilers may vary in their method of generating steam; the principle, however, remains the same, that is, to transmit heat via a heat conductor into water, which, through natural convection, reaches the boiling point and steam is generated. Such a method is time-consuming and uses expensive natural resources; when steam is not required, the boiling water cools off and energy is wasted. The Chinese patent 00228251.8 describes a device for generating high-pressure saturated steam. It comprises a motor, a water tank, a pressure gauge, a steam outlet, a steam chamber, a pressure pump or a gear pump, an atomising nozzle and a heating chamber, which are all interconnected. The water in the water tank is pumped to an atomising nozzle via a pressure pump or gear pump driven by a motor. The head of the nozzle then generates atomised mist, which turns into high-pressure, saturated steam in the heat chamber immediately after being heated. The steam is then transferred to the steam chamber, which is linked to the heat chamber. Due to the combined effect of heat and pressure from a pressure pump or gear pump, the steam in the steam chamber generated through continuous atomisation becomes high-pressure, saturated steam that meets the pressure requirements so that it can be delivered through a steam outlet with a shut-off valve to the device using the steam. Although the said device has already addressed the shortcomings and problems of long production time, high consumption of resources, waste of energy and high cost, the steam generated is at a relatively low pressure and temperature; when the steam is compressed to achieve high pressure, it tends to liquefy due to low temperature, which is unhelpful when utilising the steam.

OBJECT OF THE INVENTION

The object of this invention is to provide a device for generating high-pressure, saturated steam with the advantages of saving time and energy, lower running cost and being able to provide higher steam temperature and pressure.

THE TECHNICAL PROPOSAL OF THIS INVENTION

In order to achieve the above object, the technical proposal adopted by this invention is as follows. The said device for generating high-pressure, saturated steam is comprised of water tank, water pump, one-way valve, atomising nozzle, heating chamber and steam outlet. The pump links the tank and one-way valve, which connects to the atomising nozzle. Following the atomising nozzle, the heating chamber, which has a steam outlet, is hollow and has heating plates installed that subdivide the chamber into multiple interconnected, smaller heating cavities. The atomising nozzle is connected to the first heating cavity in the hollow chamber, whilst the last heating cavity in the chamber is connected to the steam outlet.

Compared to the state of the art, this device has the following advantages and benefits:

(1) After being atomised by the atomising nozzle and heated in the heating chamber, the water from the water tank turns into steam immediately, which avoids heating up a large amount of water for steam production. This saves time and energy.

(2) Whenever the device or the equipment to which steam is supplied does not require steam, the power supply can be switched off and atomisation will be stopped immediately. Thus the heating chamber will also stop the heating and steam generating process, thereby saving a large amount of energy.

(3) The heating plates subdivide the heating chamber into many interconnected, smaller heating cavities. As steam flows through the multiple heating cavities a curved steam current is formed. Thus the steam is heated adequately and is generated at high temperature, which prevents the steam from liquefaction.

DESCRIPTION OF ATTACHED DRAWINGS

FIG. 1: Depicts the interconnection of the device according to the invention, FIG. 2: Shows the construction of the device according to the invention FIG. 3: A cross-section along C—C of FIG. 2

Figure 4:
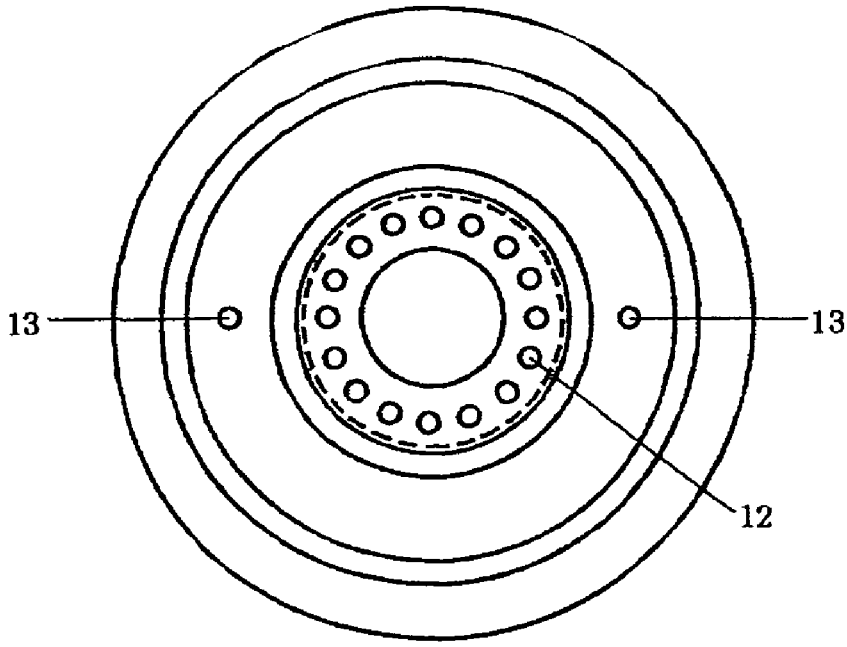

FIG. 4: A cross-section along D—D of FIG. 2

Figure 5:
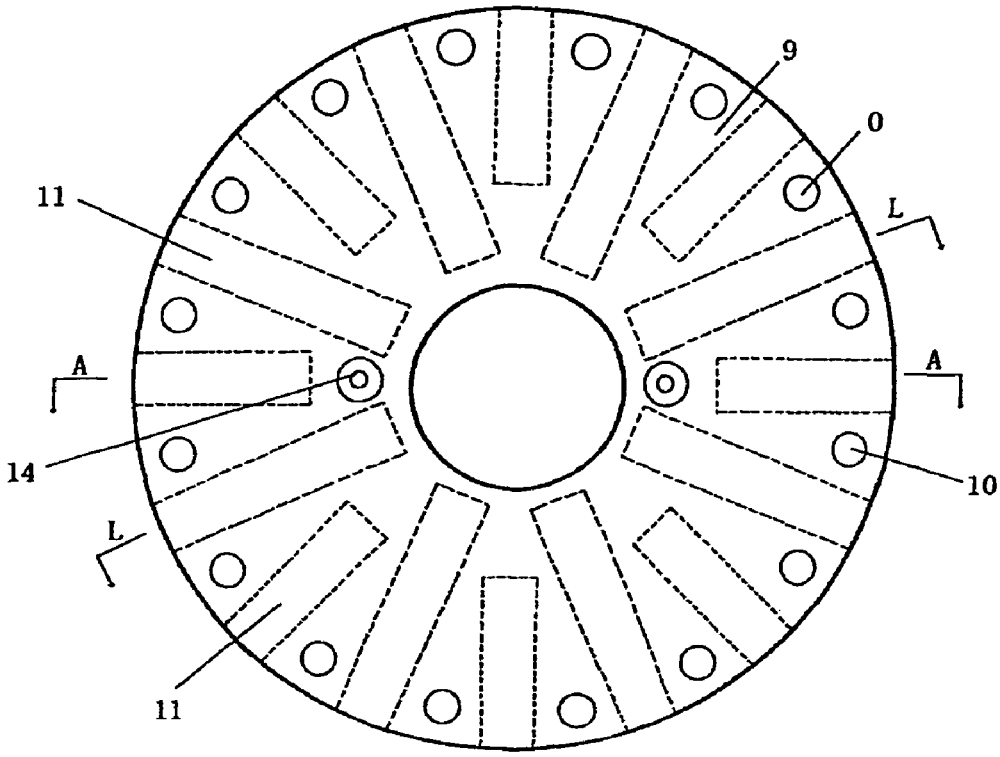

FIG. 5: The main body structure of a heating plate

Figure 6:
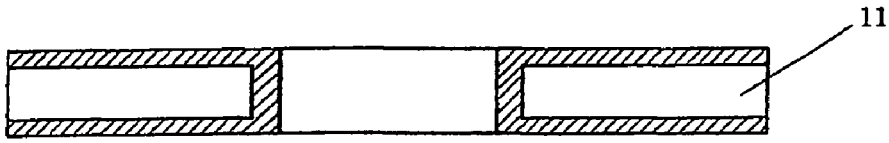

FIG. 6: A cross-section along L—L of FIG. 5

Figure 7:
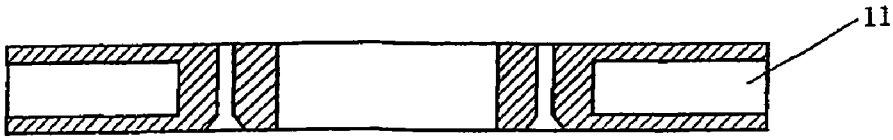

FIG. 7: A cross-section along A—A of FIG. 5

Figure 8:
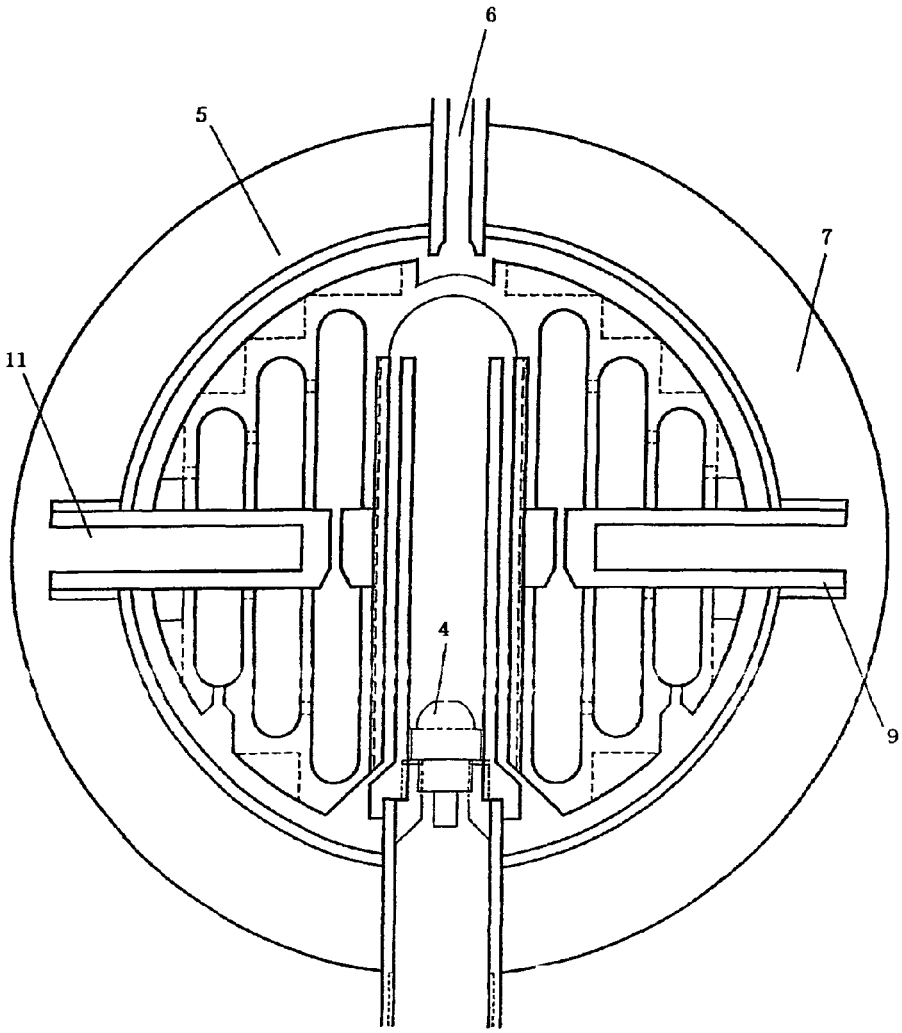

FIG. 8: An alternative construction of a heating chamber of this device

APPLICATION EXAMPLES

Example 1

As shown in FIGS. 1, 2, 3 and 4, the said device for generating high-pressure, saturated steam is comprised of water tank 1, water pump 2, one-way valve 3, atomising nozzle 4, heating chamber 5, and steam outlet 6. They are interconnected as follows: The water pump 2 links the water tank 1 and one-way valve 3, which connects to atomising nozzle 4. Joining the atomising nozzle 4, the heat chamber 5 with a steam outlet 6, is a spherical, hollow chamber 5 covered with an external thermal insulating layer 7. Installed in the spherical, hollow chamber 5 are heating plates, which subdivide the chamber into five interconnected smaller heating cavities. The atomising nozzle 4 is connected to the first heating cavity I in the spherical, hollow chamber 5 and becomes an integral part of heating plate 8, whilst the last heating cavity V in the chamber is connected to steam outlet 6. Thermal sensors and temperature gauges are installed in the last heating chamber, i.e. the fifth heating cavity V.

Figure 2:
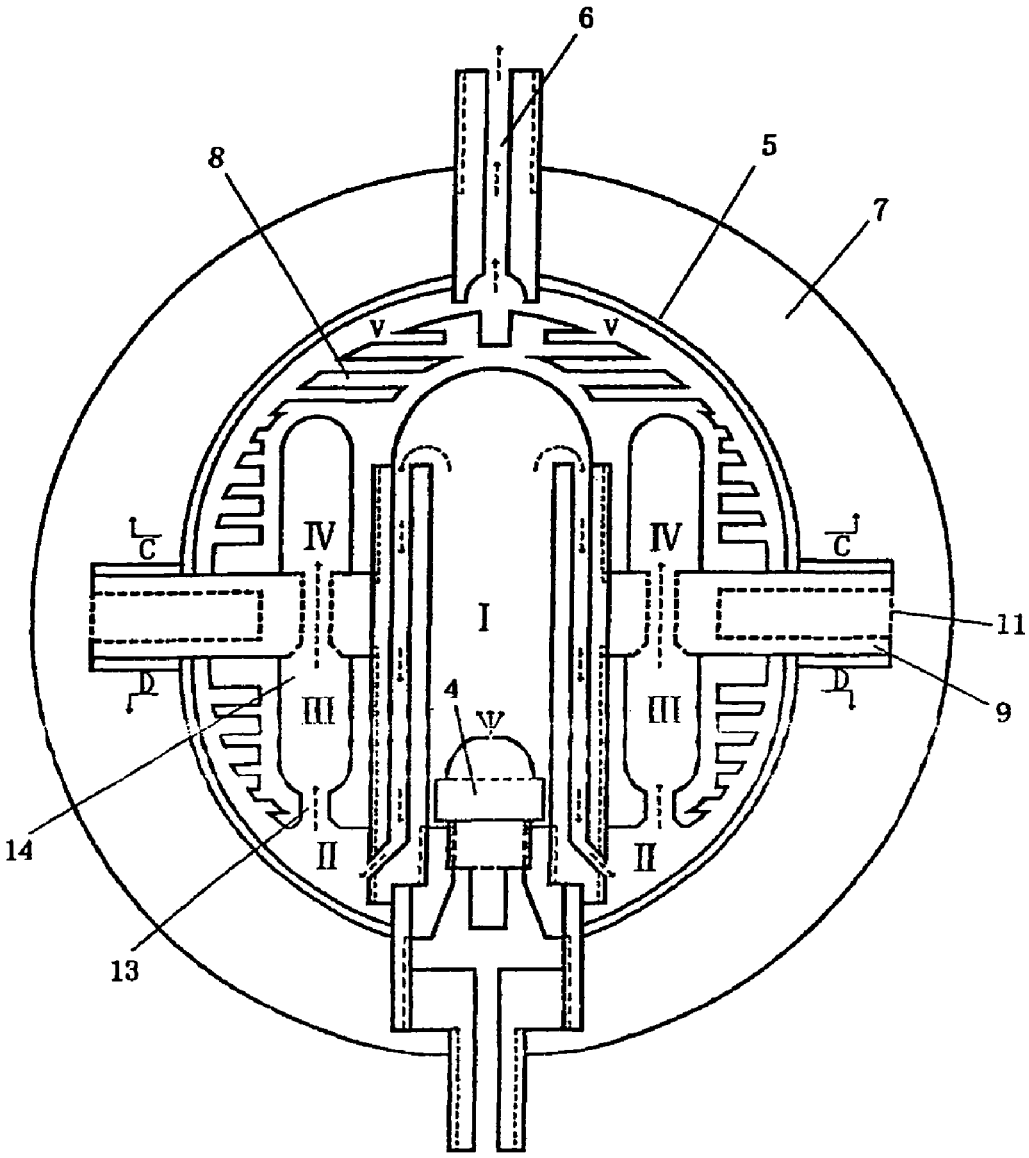
Figure 3:
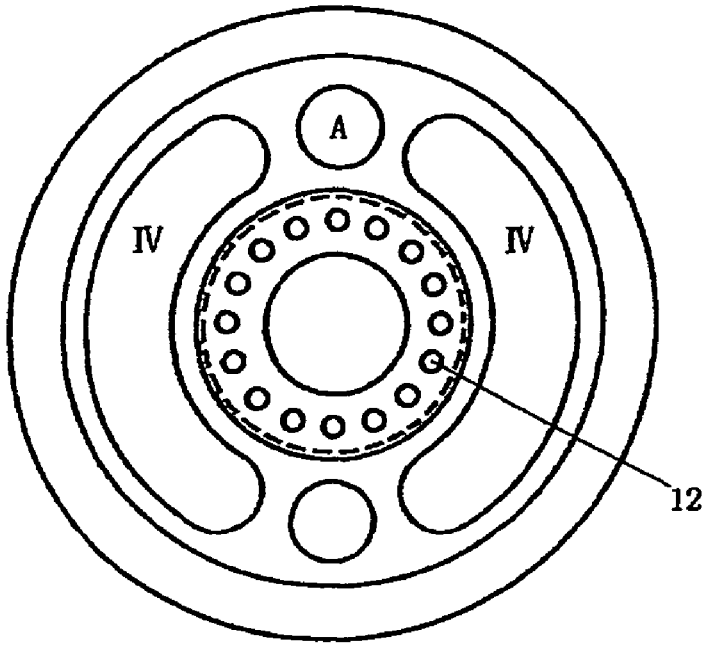

The construction of the heating plate is shown in FIG. 2, whilst the construction of the main body of the heating plate is shown in FIGS. 5, 6, and 7. The heating plate's main body 9 is a circular plate, in which a heating plate positioning hole 11 is provided to retain the heating bar. Threaded holes 10 are evenly distributed at the circumference of the plate to connect and fasten the top and bottom semi-spheres.

The working process of the above device is as follows: The arrows in FIGS. 1 and 2 show the steam flow direction in the heating chamber; the water from water tank 1 is delivered by water pump 2 via a one-way valve 3 to atomising nozzle 4 and then injected into the first heating cavity I of the spherical, hollow chamber 5 after being atomised by the atomising nozzle 4. Since the atomising nozzle 4 is heated by heating plate 8, the water mist from the atomising nozzle reaches a relatively high temperature. It is therefore easier for the water mist to turn into saturated steam at a super-high temperature after being further heated in the first heating cavity I. The arrows in FIG. 2 show the flow direction of the steam in the heating chamber. The steam flows then to the second heating cavity II via the cylindrical holes 12 located at the edge of heating cavity I. The steam, after being further heated in heating cavity II, flows to the third heating cavity III via a tube 13 between the second and third heating cavities. After being further heated in the third heating cavity III the steam flows to the fourth heating cavity IV. Following further heating in cavity IV, it enters the fifth heating cavity V and exits at outlet 6. A pressure gauge and an automatic switch can be attached to the outlet 16.

Example 2

FIG. 8 is an alternative structural diagram for subdivided heating cavities in the spherical chamber. All other details are the same as in Example 1.

The invention claimed is:

1. Device for generating high-pressure saturated steam, comprising water tank (1), water pump (2), one-way valve (3), atomising nozzle (4), heating chamber (5) and steam outlet (6), in which the water pump (2) links the water tank (1) and one-way valve (3), which connects to atomising nozzle (4), atomising nozzle (4) is connected to heating chamber (5) which has a steam outlet (6) on one side, characterised in that the heating chamber (5) is hollow, installed in which are heating plates (8) that subdivide the chamber into multiple interconnected smaller heating cavities, the atomising nozzle (4) is connected to the first heating cavity (I) in the heating chamber (5), whilst the last heating cavity in the heating chamber (5) is connected to steam outlet (6).

2. Device for generating high-pressure saturated steam according to claim 1, characterised in that the heating chamber (5) is covered externally with a thermal insulating layer (7).

3. Device for generating high-pressure saturated steam according to claim 1, characterised in that the said chamber is a spherical, hollow chamber.

4. Device for generating high-pressure saturated steam according to claim 1, characterised in that the heating plate (8) has a circular main body, in which a heating plate positioning hole (11) is provided to retain a heating bar.

* * * * *